US009084294B2

(12) United States Patent
Tsujihara et al.

(10) Patent No.: US 9,084,294 B2
(45) Date of Patent: Jul. 14, 2015

(54) HEATING DEVICE AND IMAGE FORMING APPARATUS

(71) Applicant: BROTHER KOGYO KABUSHIKI KAISHA, Nagoya-shi, Aichi-ken (JP)

(72) Inventors: Hiroyuki Tsujihara, Nagoya (JP); Tsuyoshi Maruyama, Aichi-ken (JP); Katsumi Inukai, Iwakura (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 50 days.

(21) Appl. No.: 13/748,440

(22) Filed: Jan. 23, 2013

(65) Prior Publication Data

US 2013/0195479 A1 Aug. 1, 2013

(30) Foreign Application Priority Data

Jan. 30, 2012 (JP) ..... 2012-016995

(51) Int. Cl.

| | |
|---|---|
| ***G03G 15/20*** | (2006.01) |
| ***H05B 3/02*** | (2006.01) |
| ***G03G 15/00*** | (2006.01) |

(52) U.S. Cl.

CPC ..... *H05B 3/02* (2013.01); *G03G 15/2003* (2013.01); *G03G 15/2007* (2013.01); *G03G 15/80* (2013.01)

(58) Field of Classification Search

USPC ..... 399/33; 361/91.8

See application file for complete search history.

(56) References Cited

U.S. PATENT DOCUMENTS

| | | | | |
|---|---|---|---|---|
| 4,068,281 | A | 1/1978 | Harnden, Jr. | |
| 5,043,864 | A * | 8/1991 | Inuzuka et al. | 700/81 |
| 6,683,770 | B1 * | 1/2004 | Marsh | 361/111 |
| 7,146,116 | B2 * | 12/2006 | Nonaka et al. | 399/33 |
| 7,570,892 | B2 * | 8/2009 | Nakazato et al. | 399/13 |
| 7,787,789 | B2 * | 8/2010 | Nakayama et al. | 399/69 |
| 8,027,046 | B2 * | 9/2011 | Yamasaki | 358/1.14 |
| 8,041,236 | B2 * | 10/2011 | Kim et al. | 399/33 |
| 2005/0201030 | A1 * | 9/2005 | Toth | 361/91.1 |

FOREIGN PATENT DOCUMENTS

| | | | |
|---|---|---|---|
| JP | 53-044859 | A | 4/1978 |
| JP | 53044859 | A * | 4/1978 |
| JP | S62-274583 | A | 11/1987 |

(Continued)

OTHER PUBLICATIONS

Translation of Notification of Reasons for Refusal dated Jan. 28, 2015 in Japanese Application JP2012-016995.*

(Continued)

*Primary Examiner* — Clayton E Laballe
*Assistant Examiner* — Leon W Rhodes, Jr.
(74) *Attorney, Agent, or Firm* — Merchant & Gould PC

(57) ABSTRACT

A heating device includes: an alternating current (AC) power supply line configured to supply AC current from an AC power supply; a heat generation unit configured to generate heat in accordance with the AC current; an energization regulation unit configured to regulate energization time of the AC current to the heat generation unit; a switching unit configured to switch a connection state between the AC power supply and the heat generation unit; and a high-voltage protection unit, which is connected between the AC power supply line at a rear stage of the switching unit, and which is configured to protect the energization regulation unit against an abnormal input high voltage.

17 Claims, 9 Drawing Sheets

(56) References Cited

FOREIGN PATENT DOCUMENTS

| | | | | |
|---|---|---|---|---|
| JP | 2-305408 | A | | 12/1990 |
| JP | 02305408 | A | * | 12/1990 |
| JP | 11-252789 | A | | 9/1999 |
| JP | 11252789 | A | * | 9/1999 |
| JP | 2000-134794 | A | | 5/2000 |
| JP | 2000-181305 | A | | 6/2000 |
| JP | 2000181305 | A | * | 6/2000 |
| JP | 2006-236650 | A | | 9/2006 |
| JP | 2008-003229 | A | | 1/2008 |
| JP | 2008-152143 | A | | 7/2008 |
| JP | 2008152143 | A | * | 7/2008 |

OTHER PUBLICATIONS

Office Action issued in related Japanese Patent Application No. 2012-016995, mailed Jan. 26, 2015.

* cited by examiner

HEATING DEVICE AND IMAGE FORMING APPARATUS

CROSS-REFERENCE TO RELATED APPLICATIONS

This application claims priority from Japanese Patent Application No. 2012-016995 filed on Jan. 30, 2012, the entire subject matters of which are incorporated herein by reference.

TECHNICAL FIELD

The invention relates to a heating device and an image forming apparatus, and more specifically, to a technology of protecting an energization regulation unit that regulates energization of a heating unit of a heating device.

BACKGROUND

There have been disclosed a technology of protecting an energization regulation unit that regulates energization of a heating unit of a heating device. In this related-art technology, a fixing technology is disclosed in which a triac (energization regulation unit) and a varistor (high-voltage protection unit) protecting the triac are connected in parallel with each other.

SUMMARY

One illustrative aspect of the invention provides a heating device comprising: an alternating current (AC) power supply line configured to supply AC current from an AC power supply; a heat generation unit configured to generate heat in accordance with the AC current; an energization regulation unit configured to regulate energization time of the AC current to the heat generation unit; a switching unit configured to switch a connection state between the AC power supply and the heat generation unit; and a high-voltage protection unit, which is connected between the AC power supply line at a rear stage of the switching unit, and which is configured to protect the energization regulation unit against an abnormal input high voltage.

According to this configuration, the high-voltage protection unit is provided at the rear stage of the switching unit. Therefore, while the connection state between the AC power supply and the heat generation unit is switched to the disconnection by the switching unit (e.g., while the switching unit is off), an overvoltage or lightning surge is not applied to the high-voltage protection unit. Hence, it is possible to suppress a problem from occurring in the high-voltage protection unit that protects the energization regulation unit.

DETAILED DESCRIPTION

<General Overview>

Figure 1:
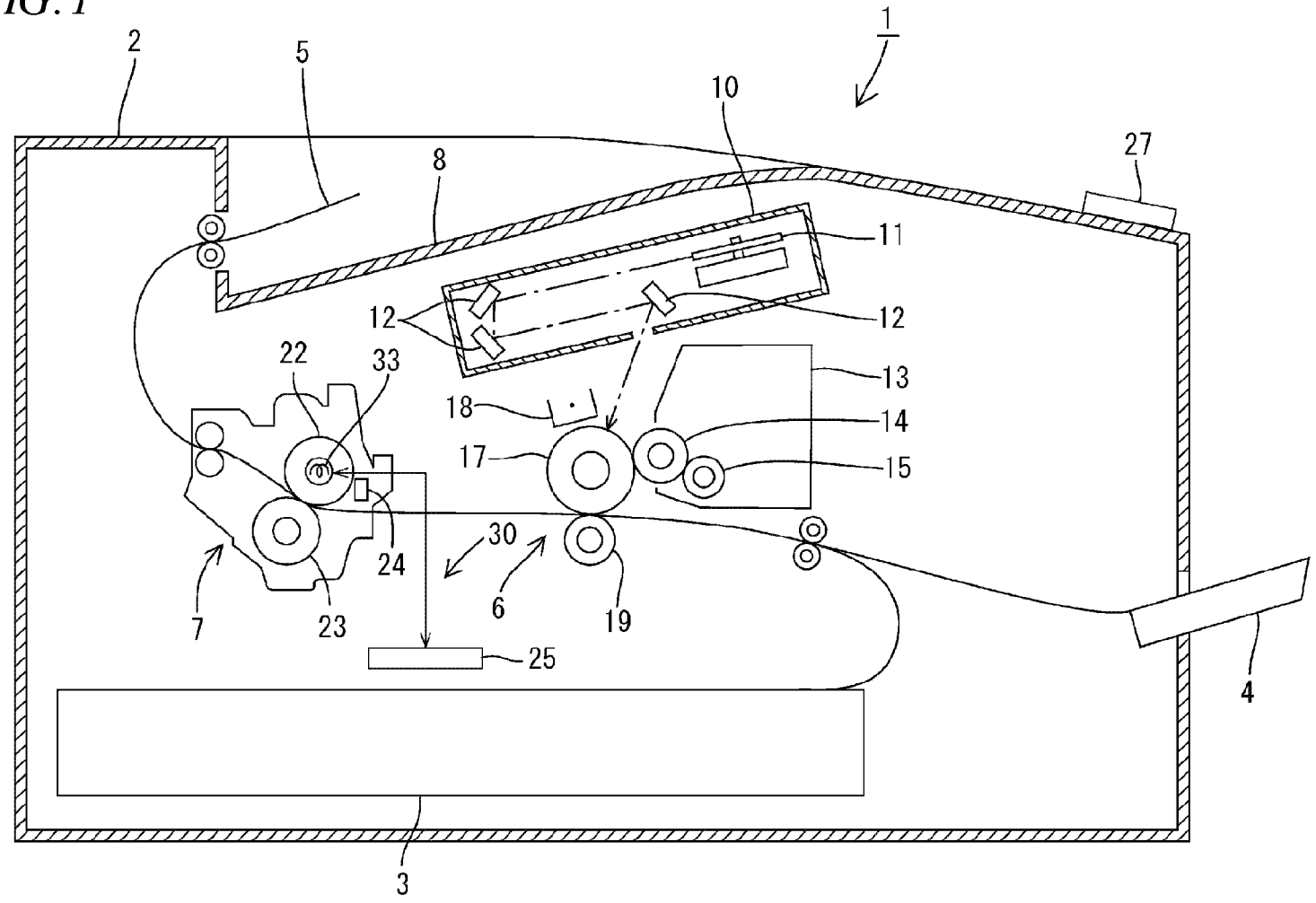
FIG. 1 is a side sectional view showing a schematic configuration of an image forming apparatus according to a first exemplary embodiment.

However, according to the above-described related-art technology, when a power supply switch of the heating device is on, there is always a possibility that the varistor may be applied with an overvoltage or lightning surge. Thereby, a possibility that the heating device will get out of order may be increased.

Therefore, illustrative aspects of the invention provide a technology capable of suppressing a problem from occurring in a high-voltage protection unit that protects an energization regulation unit in a heating device.

According to a first illustrative aspect of the invention, there is provided a heating device comprising: an alternating current (AC) power supply line configured to supply AC current from an AC power supply; a heat generation unit configured to generate heat in accordance with the AC current; an energization regulation unit configured to regulate energization time of the AC current to the heat generation unit; a switching unit configured to switch a connection state between the AC power supply and the heat generation unit; and a high-voltage protection unit, which is connected between the AC power supply line at a rear stage of the switching unit, and which is configured to protect the energization regulation unit against an abnormal input high voltage.

According to this configuration, the high-voltage protection unit is provided at the rear stage of the switching unit. Therefore, while the connection state between the AC power supply and the heat generation unit is switched to the disconnection by the switching unit (e.g., while the switching unit is off), an overvoltage or lightning surge is not applied to the high-voltage protection unit. Hence, it is possible to suppress a problem from occurring in the high-voltage protection unit that protects the energization regulation unit.

According to a second illustrative aspect of the invention, the heating device according to the first illustrative aspect further comprises a temperature protection device that is thermally coupled to the high-voltage protection unit.

According to this configuration, as the temperature protection device thermally coupled to the high-voltage protection unit, a thermal fuse and the like is provided to the AC power supply line of a power supply circuit of the heating device. Therefore, it is possible to protect the other configurations of the heating device against an abnormal input high voltage. That is, regarding the abnormal input high voltage, the safety of the heating device is improved.

According to a third illustrative aspect of the invention, the heating device according to the second illustrative aspect further comprises a regulation driving unit configured to drive the energization regulation unit, wherein the energization regulation unit is a triac, and wherein the temperature protection device is provided between the regulation driving unit and a gate of the triac.

If a high voltage such as overvoltage and lightning surge is applied to the high-voltage protection unit, so that a problem occurs in the high-voltage protection unit and a temperature of the high-voltage protection unit is thus increased, a resistance of the temperature protection device is changed. As the resistance of the temperature protection device is changed, the driving control on the triac by the regulation driving unit cannot be normally performed, so that it is not possible to normally control the temperature of the heat generation unit. Therefore, based on the detection of the heat-generation abnormality of the heat generation unit, it is possible to detect the problem of the high-voltage protection unit. As a result, the safety of the heating device is improved.

According to a fourth illustrative aspect of the invention, in the heating device according to the third illustrative aspect, the temperature protection device is a thermal fuse.

In this case, when the thermal fuse is disconnected due to the heat generation of the high-voltage protection unit, the control on the gate of the traic cannot be performed, so that it is not possible to enable the heat generation unit to generate the heat. As a result, it is possible to detect the problem of the high-voltage protection unit from the heat-generation abnormality of the heat generation unit.

According to a fifth illustrative aspect of the invention, in the heating device according to the third illustrative aspect, the temperature protection device is a positive temperature coefficient (PTC) thermistor.

In this case, when the temperature of the high-voltage protection unit is increased due to a problem of the high-voltage protection unit, a resistance value of the PTC thermistor is increased. Thereby, it is not possible to normally control the gate of the triac, so that it is not possible to enable the heat generation unit to generate the heat. Accordingly, it is possible to detect the problem of the high-voltage protection unit from the heat-generation abnormality of the heat generation unit.

According to a sixth illustrative aspect of the invention, the heating device according to the second illustrative aspect further comprises a regulation driving unit configured to drive the energization regulation unit, wherein the energization regulation unit is a triac, wherein the temperature protection device is a negative temperature coefficient (NTC) thermistor, wherein the regulation driving unit is connected to a gate of the triac, and wherein the NTC thermistor is connected between the gate of the triac and one input/output terminal of the triac.

Also in this configuration, when the temperature of the high-voltage protection unit is increased due to a problem of the high-voltage protection unit, a resistance value of the NTC thermistor is decreased. Thereby, even though the control on the gate of the triac by the regulation driving unit is not performed, the triac becomes on. As a result, the heat generation unit generates the heat. Based on this, it is possible to detect the problem of the high-voltage protection unit.

According to a seventh illustrative aspect of the invention, the heating device according to the second illustrative aspect further comprises: a switching driving unit configured to drive the switching unit; and a switching unit driving line that connects the switching unit and the switching driving unit, wherein the temperature protection device is provided on the switching unit driving line.

According to this configuration, when the temperature of the high-voltage protection unit is increased due to a problem of the high-voltage protection unit, a resistance of the temperature protection device is changed. As the resistance of the temperature protection device is changed, it is not possible to normally perform the driving control of the switching unit by the switching driving unit. Thereby, it is not possible to normally perform the temperature control of the heat generation unit. Therefore, by detecting the heat-generation abnormality of the heat generation unit, it is possible to detect the problem of the high-voltage protection unit. As a result, the safety of the heating device is improved.

According to an eighth illustrative aspect of the invention, in the heating device according to the seventh illustrative aspect, the temperature protection device is a thermal fuse.

In this case, when the thermal fuse is disconnected due to the heat generation of the high-voltage protection unit, the driving control of the switching unit by the switching driving unit cannot be normally performed, so that it is not possible to enable the heat generation unit to generate the heat. From this, it is possible to detect the problem of the high-voltage protection unit.

According to a ninth illustrative aspect of the invention, in the heating device according to the seventh illustrative aspect, the temperature protection device is a PTC thermistor.

In this case, when the temperature of the high-voltage protection unit is increased due to a problem of the high-voltage protection unit, a resistance value of the PTC thermistor is increased. Thereby, it is not possible to normally perform the driving control of the switching unit by the switching driving unit, so that it is not possible to enable the heat generation unit to normally generate the heat. Based on this, it is possible to detect the problem of the high-voltage protection unit.

According to a tenth illustrative aspect of the invention, the heating device according to the second aspect further comprises: a switching driving unit configured to drive the switching unit; a low-voltage power supply circuit configured to generate a direct current voltage to be supplied to the switching driving unit; and a power supply line that connects the AC power supply and the low-voltage power supply circuit, wherein the temperature protection device is provided on the power supply line.

According to this configuration, when the temperature of the high-voltage protection unit is increased due to a problem of the high-voltage protection unit, an operation of the low-voltage power supply circuit is limited due to the operation of the temperature protection device. Thereby, it is not possible to perform the driving of the switching unit by the switching driving unit, so that it is possible to interrupt the supply of the AC power supply to the high-voltage protection unit. As a result, the safety of the heating device is improved.

According to an eleventh illustrative aspect of the invention, in the heating device according to the tenth illustrative aspect, the temperature protection device is a thermal fuse.

In this case, as the thermal fuse is disconnected due to the temperature increase of the high-voltage protection unit, it is possible to securely turn off the operation of the low-voltage power supply circuit and to securely turn off the switching unit.

According to a twelfth illustrative aspect of the invention, the heating device according to the second illustrative aspect further comprises: a zero-cross detection unit, which is connected between the AC power supply line at a rear stage of the switching unit, and which is configured to generate a zero-cross pulse signal for detecting a zero-cross point of the AC current; and a zero-cross line that connects the AC power supply and the zero-cross detection unit, wherein the temperature protection device is provided on the zero-cross line.

According to this configuration, when the resistance of the temperature protection device is changed due to the temperature increase of the high-voltage protection unit, a pulse width of the zero-cross pulse signal is changed. As the pulse width of the zero-cross pulse signal is changed from a usual value, it is possible to detect the problem of the high-voltage protection unit. As a result, the safety of the heating device is improved.

According to a thirteenth illustrative aspect of the invention, in the heating device according to the twelfth illustrative aspect, the temperature protection device is an NTC thermistor.

In this case, when the temperature of the high-voltage protection unit is increased, a resistance of the NTC thermistor is decreased, so that a pulse width of the zero-cross pulse signal becomes larger than usual. Based on this, it is possible to detect the problem of the high-voltage protection unit.

According to a fourteenth illustrative aspect of the invention, in the heating device according to the twelfth illustrative aspect, the temperature protection device is a PTC thermistor.

In this case, when the temperature of the high-voltage protection unit is increased, a resistance value of the PTC thermistor is increased, so that the pulse width of the zero-cross pulse signal is decreased than usual. Based on this, it is possible to detect the problem of the high-voltage protection unit.

According to a fifteenth illustrative aspect of the invention, the heating device further comprises an AC current detection unit that is provided on an AC path that is formed by the AC power supply and the high-voltage protection unit.

When the high-voltage protection unit is normal, the AC current flows in an AC path through the high-voltage protection unit. Therefore, when a predetermined AC current is detected in the AC path, it is possible to detect that the high-voltage protection unit is not normal.

According to a sixteenth illustrative aspect of the invention, there is provided an image forming apparatus comprising: an image forming unit configured to form a toner image on a recording medium; and a fixing unit, which comprises the heating device according to any one of the first to fifteenth illustrative aspects, and which is configured to fix the toner image formed by the image forming unit on the recording medium.

According to a seventeenth illustrative aspect of the invention, in the image forming apparatus according to the sixteenth illustrative aspect, the image forming apparatus has a using mode, in which the image forming apparatus is at a using state, and a low-power mode, in which power consumption is lower than in the using mode, and the switching unit is configured to switch the connection state to a connection in the using mode, and to switch the connection state to a disconnection in the low-power mode.

According to this configuration, when the heating device is used to heat the fixing unit of the image forming apparatus, after a power supply switch of the image forming apparatus becomes on, the time during which the image forming apparatus is in the low-power mode is longer than the time during which the image forming apparatus is in the using mode. Therefore, it is possible to highly suppress the problem of the varistor 38.

According to the above-described illustrative aspects of the invention, it is possible to suppress a problem from occurring in the high-voltage protection unit that protects the energization regulation unit in the heating device.

First Exemplary Embodiment

In the below, a first exemplary embodiment of the invention will be described with reference to FIGS. 1 to 5.

(Configuration of Laser Printer)

FIG. 1 is a schematic longitudinal sectional view of a monochrome laser printer 1 (which is one example of the 'image forming apparatus') according to a first exemplary embodiment. Incidentally, the image forming apparatus is not limited to the monochrome laser printer and may be also a color laser printer, a color LED printer, a complex machine and the like, for example.

In the monochrome laser printer (hereinafter, referred to as 'printer') 1, an image forming unit 6 forms a toner image on a sheet 5 that is fed from a tray 3 arranged at a lower part in a body casing 2 or from a manual bypass tray 4, a fixing device (one example of a fixing unit) 7 heats and fixes the toner image and then the sheet 5 is discharged onto a sheet discharge tray 8 positioned at an upper part in the body casing 2.

The image forming unit 6 includes a scanner unit 10, a developing cartridge 13, a photosensitive drum 17, a charger 18, a transfer roller 19 and the like.

The scanner unit 10 is disposed at the upper part in the body casing 2. The scanner unit 10 includes a laser light emitting unit (not shown), a polygon mirror 11, a plurality of reflectors 12, a plurality of lenses (not shown) and the like. The scanner unit 10 is configured to scan the laser light, which is emitted from the laser light emitting unit, onto a surface of the photosensitive drum 17 at high speed through the polygon mirror 11, the reflectors 12 and the like, as shown with a dashed-dotted line.

The developing cartridge 13 is detachably mounted to the printer 1. The developing cartridge 13 is configured to accommodate toner. A developing roller 14 and a supply roller 15 are provided to face each other at a toner supply port of the developing cartridge 13, and the developing roller 14 is also disposed to face the photosensitive drum 17. As the supply roller 15 is rotated, the toner in the developing cartridge 13 is supplied to the developing roller 14 and is then carried on the developing roller 14.

The charger 18 is arranged above the photosensitive drum 17 at an interval. The transfer roller 19 is disposed below the photosensitive drum 17 so as to face the photosensitive drum 17.

The surface of the photosensitive drum 17 is rotated and uniformly positively charged by the charger 18, for example. Then, an electrostatic latent image is formed on the photosensitive drum 17 by the laser light emitted from the scanner unit 18. After that, when the photosensitive drum 17 rotates with contacting the developing roller 14, the toner carried on the developing roller 14 is supplied and carried to the electrostatic latent image on the surface of the photosensitive drum 17, so that a toner image is formed. Then, the toner image is transferred to the sheet 5 by a transfer bias that is applied to the transfer roller 19 while the sheet 5 passes between the photosensitive drum 17 and the transfer roller 19.

The fixing device 7 is disposed at a downstream side of a sheet conveyance direction as regards the image forming unit 6. The fixing device 7 includes a fixing roller 22, a pressing roller 23 that presses the fixing roller 23, a halogen heater 33 (which is one example of the 'heat generation unit' of the invention) that is configured to heat the fixing roller 22, and the like. The halogen heater 33 is connected to a circuit board 25, and energization thereof is controlled by a signal output from the circuit board 25. A temperature sensor 24 configured to detect a temperature of the halogen heater 33 is provided in the vicinity of the halogen heater 33.

The printer 1 includes a display device 27 that displays print information and the like.

(Electrical Configuration of Heating Device)

Figure 2:
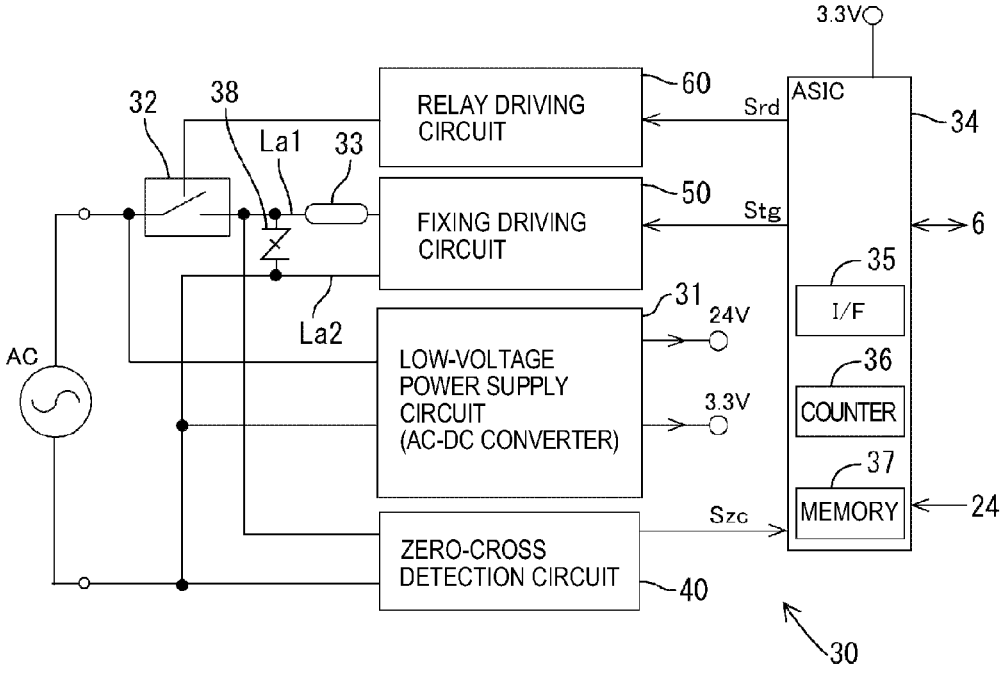
FIG. 2 is a block diagram showing a schematic configuration of a heating device according to the first exemplary embodiment.
Figure 3:
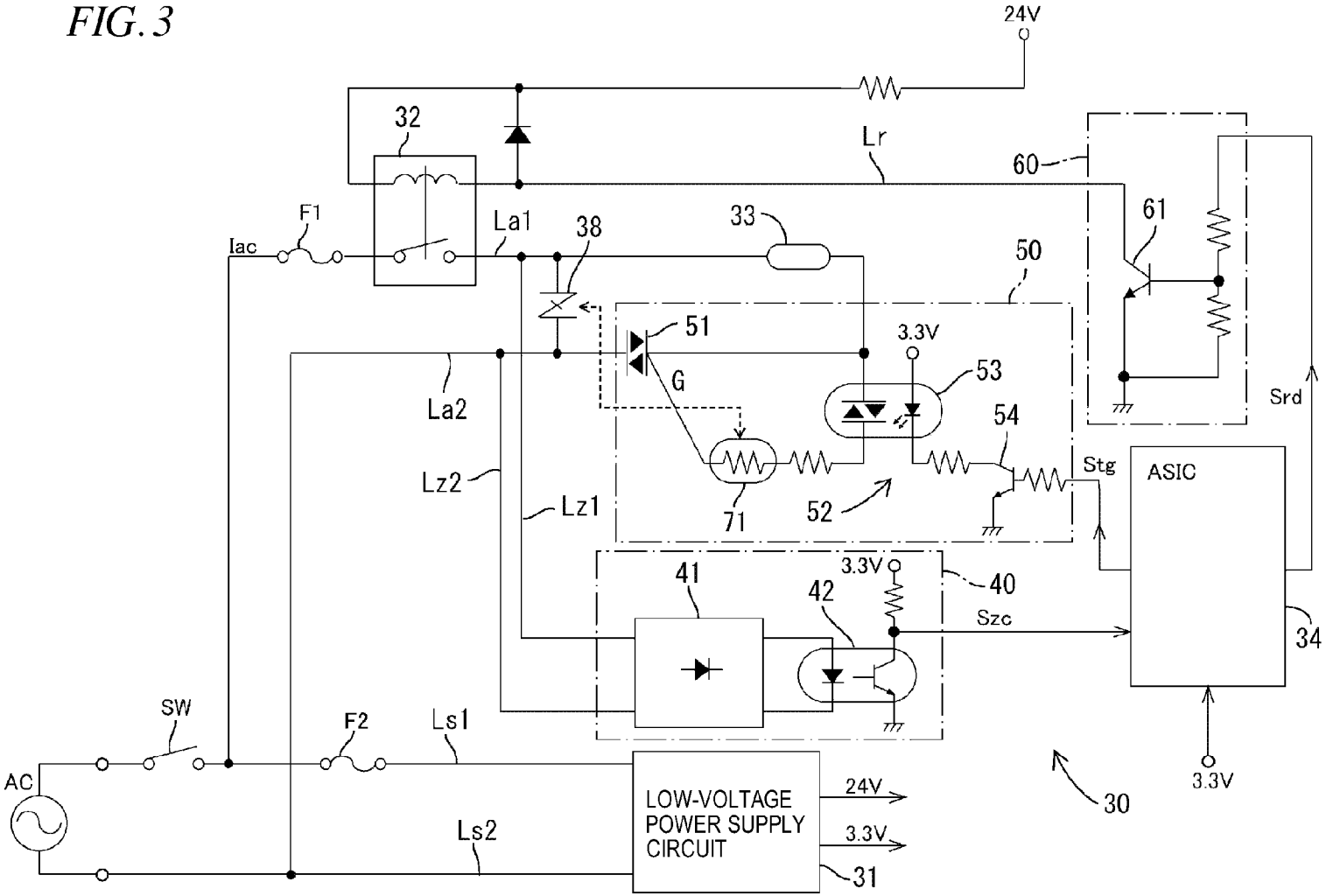
FIG. 3 is a schematic circuit diagram of the heating device according to the first exemplary embodiment.

Subsequently, a heating device 30 provided to the printer 1 will be described with reference to FIGS. 2 and 3. FIG. 2 is a block diagram showing a schematic configuration of the heating device 30. FIG. 3 is a schematic circuit diagram of the heating device 30.

The heating device 30 includes a low-voltage power supply circuit (AC-DC converter) 31, a fixing relay 32, the halogen heater 33, an ASIC (application specific integrated circuit) 34, a varistor 38, a zero-cross detection circuit 40, a fixing driving circuit 50, a relay driving circuit 60 and the like. The heating device 30 includes a power supply switch SW and current fuses F1, F2.

The low-voltage power supply circuit 31 is configured to convert an alternating current (AC) voltage of 100V into direct current voltages of 24V and 3.3V, for example, and to supply the direct current voltages to respective units. In the heating device 30 shown in FIG. 3, the fixing relay 32 and the relay driving circuit 60 are supplied with the direct current voltage of 24V from the low-voltage power supply circuit 31, and the ASIC 34, the zero-cross detection circuit 40 and the fixing driving circuit 50 are supplied with the direct current voltage of 3.3V from the low-voltage power supply circuit 31. The halogen heater 33 generates heat as AC current Iac from an alternating current power supply AC is supplied thereto.

The zero-cross detection circuit 40, which is one example of the zero-cross detection unit, is connected between alternating current power supply lines La1, La2 at a rear stage of the fixing relay 32 and is configured to generate a zero-cross pulse signal Szc that detects a zero-cross point of the AC current Iac. Specifically, the zero-cross detection circuit 40 includes a zero-cross detector 41 including a full wave rectification bridge, a comparator (not shown) and the like and a photo-coupler 42. A voltage rectified by the full wave rectification bridge and a reference voltage are compared by the comparator, so that a zero-cross pulse signal Szc is generated. The zero-cross pulse signal Szc is supplied to the ASIC 34 through the photo-coupler 42.

The fixing driving circuit 50 is configured to regulate energization time of the AC current Iac to the halogen heater 33, based on the zero-cross pulse signal Szc. Specifically, the fixing driving circuit 50 includes a triac 51, a photo triac coupler 53 and a driving transistor 54, as shown in FIG. 3.

The triac 51, which is one example of the energization regulation unit, is configured to regulate the energization time of the AC current Iac. The photo triac coupler 53 and the driving transistor 54 configure a regulation driving unit 52, which drives the triac 51.

Specifically, the photo triac coupler 53 becomes on by the driving transistor 54 in response to a trigger signal Stg that is generated as a dropping basis of the zero-cross pulse signal Szc. As the photo triac coupler 53 becomes on, the triac 51 becomes on, so that the AC current Iac is supplied to the halogen heater 33 during predetermined energization time. Temperature control on the fixing device 7 by the halogen heater 33 is performed by varying the energization time.

When the printer 1 is connected to the alternating current power supply AC, the fixing relay 32, which is one example of the switching unit, is connected between the alternating current power supply AC and the halogen heater 33 and switches a connection state between the alternating current power supply AC and the halogen heater 33. That is, the fixing relay 32 is configured to connect and disconnect the alternating current power supply AC and the halogen heater 33. Incidentally, the switching unit is not limited to the relay and may be configured by a semiconductor device, for example.

The relay driving circuit 60, which is one example of the switching driving unit, includes a driving transistor 61 and is configured to drive the fixing relay 32 in response to a relay driving signal Srd from the ASIC 34. Specifically, the driving transistor 61 becomes on/off in response to the relay driving signal Srd and the energization of a coil of the fixing relay 32 becomes on/off in response to the on/off of the driving transistor 61.

The ASIC 34, which configures a part of the regulation driving unit and the switching driving unit, includes an interface circuit 35, a counter 36, a memory 37 and the like. The ASIC 34 is configured to control the energization of the fixing device 7. The interface circuit 35 is configured to relay transmission and reception of a variety of data to and from an outside of the ASIC 34. The counter 36 is used to measure a pulse width of the zero-cross pulse signal Szc, for example, when controlling the energization of the fixing device 7. The memory 37 includes a ROM and a RAM.

The ASIC 34 is configured to generate a trigger signal Stg, based on the zero-cross pulse signal Szc and supply the trigger signal Stg to the fixing driving circuit 50 via a relay driving line Lr. Further, the ASIC 34 is configured to generate a relay driving signal Srd for turning on/off the fixing relay 32 and supply the relay driving signal Srd to the relay driving circuit 60. The ASIC 34 is connected to the image forming unit 6 and is configured to perform a variety of processing about the image formation, in addition to the energization control of the fixing device 7.

The varistor 38, which is one example of the high-voltage protection unit, is connected between the alternating current power supply lines La1, La2 at a rear stage of the fixing relay 32 and is configured to protect the triac 51 against an abnormal input high voltage.

A PTC (Positive Temperature Coefficient) thermistor 71, which is one example of the temperature protection device, is provided between the regulation driving unit 52 and a gate G of the triac 51. The PTC thermistor 71 is thermally coupled to the varistor 38. Thus, as a temperature of the varistor 38 is changed, a temperature of the PTC thermistor 71 is also changed. Therefore, as the temperature of the varistor 38 is increased, the temperature of the PTC thermistor 71 is also increased and a resistance value of the PTC thermistor 71 is increased.

(Operations/Effects of Heating Device of First Exemplary Embodiment)

According to the above-described heating device 30, the varistor 38 is provided at the rear stage of the fixing relay 32. Thus, when the fixing relay 32 is off, the electrical connection between the alternating current power supply AC and the varistor 38 is disconnected. That is, while the fixing relay 32 is off and the connection state between the alternating current power supply AC and the varistor 38 is thus switched to the disconnection, an overvoltage or lightning surge is not applied to the varistor 38. Therefore, it is possible to suppress the problem that an overvoltage or lightning surge is applied to the varistor 38 protecting the triac 51. Thereby, the safety of the heating device 30 is improved.

On the other hand, while the fixing relay 32 is on so as to heat the halogen heater 33, when an overvoltage or lightning surge is applied to the varistor 38 and thus the varistor 38 abnormally generates the heat, the temperature of the PTC thermistor 71 thermally coupled to the varistor 38 is also increased. Accompanied with this, the resistance value of the PTC thermistor 71 is increased. Thereby, the control on the gate G of the triac 51 by the regulation driving unit 52 is not normally performed and the temperature of the halogen heater 33 is not normally increased within predetermined time. Thus, it is possible to detect the heating abnormality of the heating device 30 by detecting the temperature of the halogen heater 33 with the temperature sensor 24 and the ASIC 34. When the heating abnormality is detected, the ASIC 34 turns off the fixing relay 32 and displays an error on the display device 27, for example. Thereby, it is possible to inform a user of the heating abnormality of the heating device 30, thereby urging the user to cope with the situation. By the measures, it is possible to detect the problem of the varistor 38 and to suppress the influence that is caused due to the problem of the varistor 38.

Further, since the PTC thermistor 71 is provided at a portion in which only small current flows, it is possible to use the PTC thermistor 71 having small rated current.

(Modification to First Exemplary Embodiment)

Figure 4:
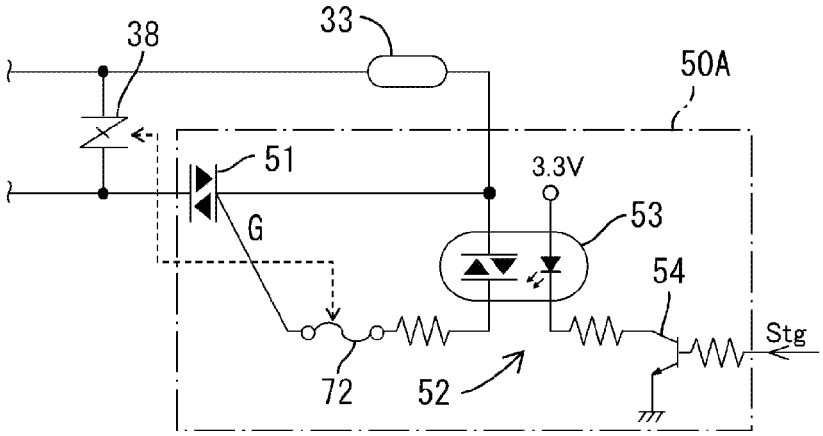
FIG. 4 is a circuit diagram showing another temperature protection device in the first exemplary embodiment.

Incidentally, as shown in FIG. 4, a thermal fuse 72 may be used as the temperature protection device thermally coupled to the varistor 38 instead of the PTC thermistor 71. Also in this case, when the varistor 38 abnormally generates heat and the thermal fuse 72 is disconnected due to the abnormal heat generation, it is not possible to control the gate G of the triac 51. Thus, it is not possible to enable the halogen heater 33 to generate heat, so that the heating abnormality of the heating device 30 is securely detected and the problem of the varistor 38 can be thus detected on the basis of the detection. Further, since the thermal fuse 72 is provided at a portion in which only small current flows, it is possible to use the thermal fuse 72 having small rated current.

Figure 5:
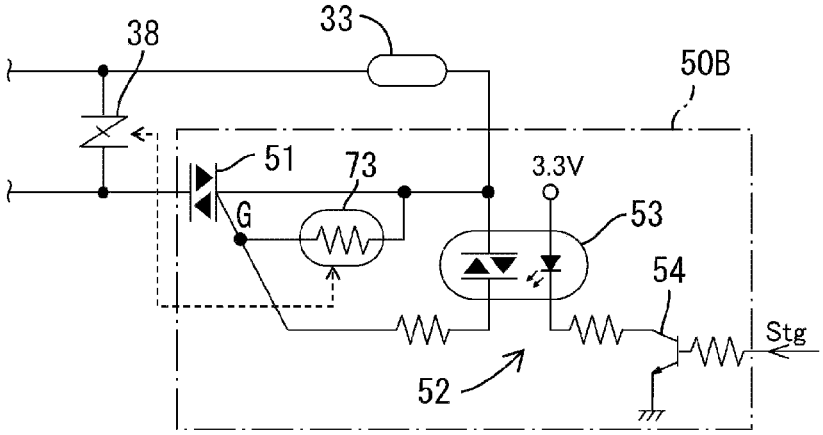
FIG. 5 is a circuit diagram showing another temperature protection device in the first exemplary embodiment.

Further, as shown in FIG. 5, an NTC (Negative Temperature Coefficient) thermistor 73 may be connected between the gate G of the triac 51 and any one I/O terminal of the triac, as the temperature protection device thermally coupled to the varistor 38. In this case, when the varistor 38 abnormally generates heat and the temperature of the NTC thermistor 73 is increased due to the abnormal heat generation, a resistance value of the NTC thermistor 73 is correspondingly decreased. Thereby, the control on the gate G of the triac 51 by the regulation driving unit 52 is not normally performed or the triac 51 becomes on even though the control on the gate G is not performed. As a result, the temperature of the halogen heater 33 is abnormally changed. Thereby, it is possible to detect the heating abnormality of the heating device 30 by detecting the temperature of the halogen heater 33, and it is possible to detect the problem of the varistor 38 from the detection of the heating abnormality of the heating device 30.

Second Exemplary Embodiment

Figure 6:
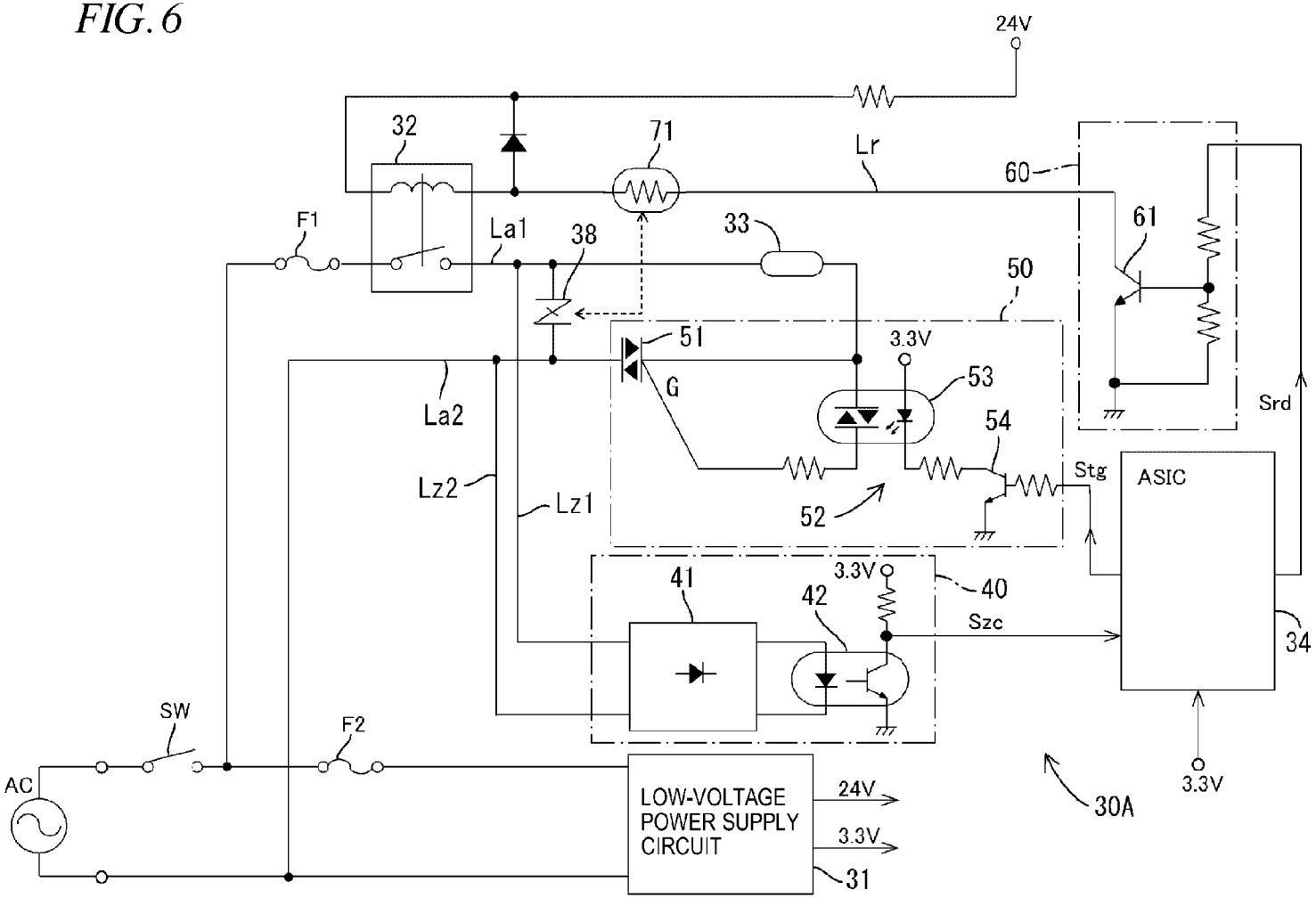
FIG. 6 is a schematic circuit diagram of a heating device according to a second exemplary embodiment.
Figure 7:
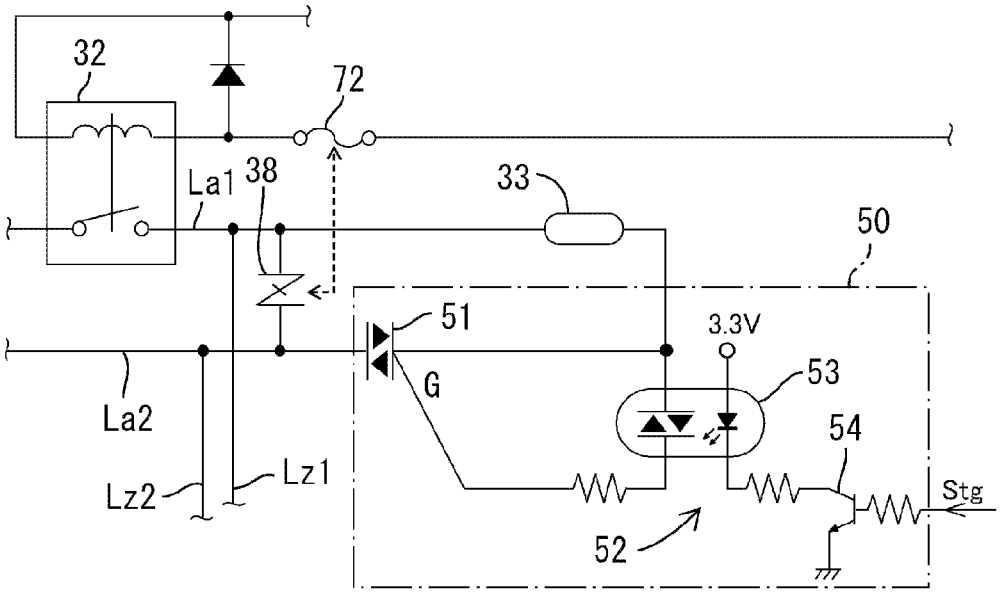
FIG. 7 is a circuit diagram showing another temperature protection device in the second exemplary embodiment.

Subsequently, a heating device 30A according to a second exemplary embodiment of the invention will be described with reference to FIGS. 6 and 7. FIG. 6 is a schematic circuit diagram of the heating device 30A according to the second exemplary embodiment, and FIG. 7 is a partial circuit diagram showing a modified exemplary embodiment of the second exemplary embodiment. The second exemplary embodiment is different from the first exemplary embodiment, as regards a place where the temperature protection device is provided. Hence, the same members as those of the first exemplary embodiment are indicated with the same reference numerals and the descriptions thereof are omitted.

In the second exemplary embodiment, the PTC thermistor 71 serving as the temperature protection device thermally coupled to the varistor 38 is provided on the relay driving line (which corresponds to the switching unit driving line) Lr connecting the fixing relay 32 and the relay driving circuit 60, as shown in FIG. 6.

(Operations/Effects of Heating Device of Second Exemplary Embodiment)

In the heating device 30A of the second exemplary embodiment, the operations and effects when the fixing relay 32 is off are the same as those of the first exemplary embodiment.

On the other hand, while the fixing relay 32 is on so as to heat the halogen heater 33, when the varistor 38 abnormally generates heat, the temperature of the PTC thermistor 71 thermally coupled to the varistor 38 is increased. Accompanied with this, the resistance value of the PTC thermistor 71 is increased. Thereby, a resistance of the relay driving line Lr1 is increased and the relay driving current from the relay driving circuit 60 is thus decreased. As a result, it is not possible to sufficiently excite the coil of the fixing relay 32, so that the fixing relay 32 becomes off and thus the energization to the halogen heater 33 is interrupted. Therefore, even though the control signal for heating the halogen heater 33, i.e., the trigger signal Stg is being supplied from the ASIC 34 to the fixing driving circuit 50, the halogen heater 33 is not heated. Hence, it is possible to detect the heating abnormality of the heating device 30A by detecting the temperature of the halogen heater 33 with the temperature sensor 24 and the ASIC 34. When the heating abnormality is detected, the ASIC 34 stops the heating control on the halogen heater 33 and displays an error on the display device 27, for example. Thereby, it is possible to inform a user of the heating abnormality of the heating device 30A, thereby urging the user to cope with the situation. By the measures, it is possible to detect the problem of the varistor 38 and to suppress the influence that is caused due to the problem of the varistor 38.

(Modification to Second Exemplary Embodiment)

Incidentally, as shown in FIG. 7, the thermal fuse 72 may be used as the temperature protection device thermally coupled to the varistor 38 instead of the PTC thermistor 71, like the first exemplary embodiment. In this case, when the varistor 38 abnormally generates heat and the thermal fuse 72 is disconnected due to the abnormal heat generation, it is not possible to feed the driving current from the relay driving circuit 60 to the fixing relay 32 through the relay driving line Lr1, so that the fixing relay 32 becomes securely off. Thereby, it is not possible to enable the halogen heater 33 to generate heat, so that the heating abnormality of the heating device 30 is securely detected. Based on the detection, it is possible to detect the problem of the varistor 38.

Third Exemplary Embodiment

Figure 8:
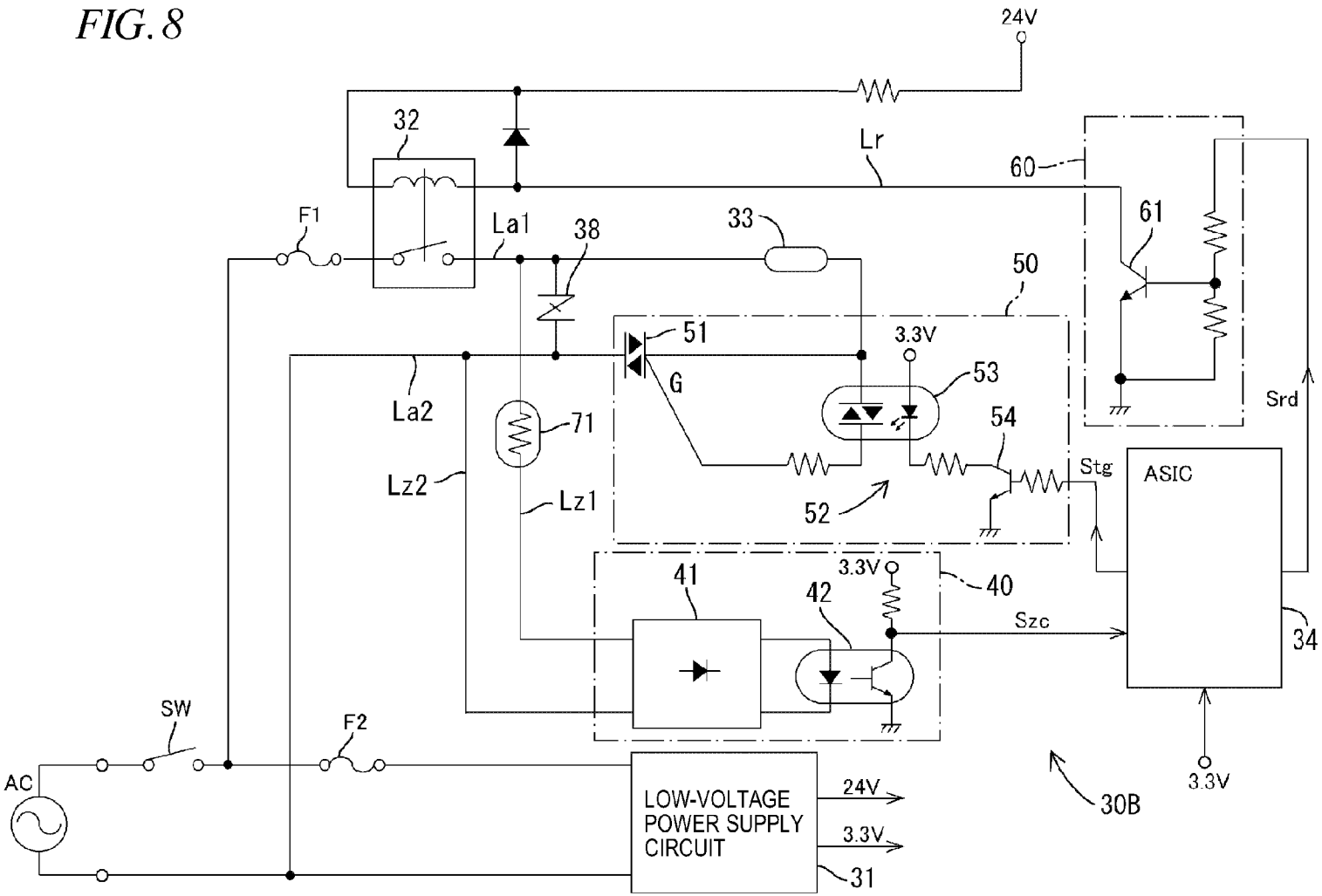
FIG. 8 is a schematic circuit diagram of a heating device according to a third exemplary embodiment.

Subsequently, a heating device 30B according to a third exemplary embodiment of the invention will be described with reference to FIG. 8. FIG. 8 is a schematic circuit diagram of the heating device 30B according to the third exemplary embodiment. The third exemplary embodiment is also different from the first exemplary embodiment, as regards the place where the temperature protection device is provided. Hence, the same members as those of the first exemplary embodiment are indicated with the same reference numerals and the descriptions thereof are omitted.

In the third exemplary embodiment, the PTC thermistor 71 serving as the temperature protection device thermally coupled to the varistor 38 is provided on one zero-cross line Lz1 connecting the alternating current power supply AC and the zero-cross detection circuit 40, as shown in FIG. 8.

(Operations/Effects of Heating Device of Third Exemplary Embodiment)

Also in the heating device 30B of the third exemplary embodiment, the operations and effects when the fixing relay 32 is off are the same as those of the first exemplary embodiment.

On the other hand, while the fixing relay 32 is on so as to heat the halogen heater 33, when the varistor 38 abnormally generates heat, the temperature of the PTC thermistor 71 thermally coupled to the varistor 38 is increased. Accompanied with this, the resistance value of the PTC thermistor 71 is increased. Thereby, a resistance value of the zero-cross line Lz1 is increased. As the resistance value of the zero-cross line Lz1 is increased, the rectification voltage of the zero-cross detection circuit 40 is decreased. Therefore, the pulse width of the zero-cross pulse signal Szc is decreased, compared to the usual case, and it is not possible to obtain the zero-cross pulse signal Szc having a desired pulse width. That is, it is possible to detect the heating abnormality of the heating device 30B by detecting the variation in the pulse width of the zero-cross pulse signal Szc with the ASIC 34. When the heating abnormality is detected, the ASIC 34 stops the heating control on the halogen heater 33 and displays an error on the display device 27, for example. Thereby, it is possible to inform a user of the heating abnormality of the heating device 30A, thereby urging the user to cope with the situation. By the measures, it is possible to detect the problem of the varistor 38 and to suppress the influence that is caused due to the problem of the varistor 38.

(Modification to Third Exemplary Embodiment)

Incidentally, the NTC thermistor 73 may be used instead of the PTC thermistor 71, as the temperature protection device. In case of the NTC thermistor 73, when the temperature of the varistor 38 is increased, the resistance of the NTC thermistor 73 is decreased, so that the pulse width of the zero-cross pulse signal Szc is increased, compared to a usual case. Thereby, it is possible to detect the problem of the varistor 38 by detecting the variation in the pulse width, like the PTC thermistor 71.

Alternatively, the thermal fuse 72 may be used instead of the PTC thermistor 71. In this case, when the varistor 38 abnormally generates heat and the thermal fuse 72 is disconnected due to the abnormal heat generation, the AC current Iac is not supplied to the zero-cross detection circuit 40 and the zero-cross pulse signal Szc is not generated. This is detected by the ASIC 34, so that the problem of the varistor 38 can be detected, like the thermistor.

Fourth Exemplary Embodiment

Figure 9:
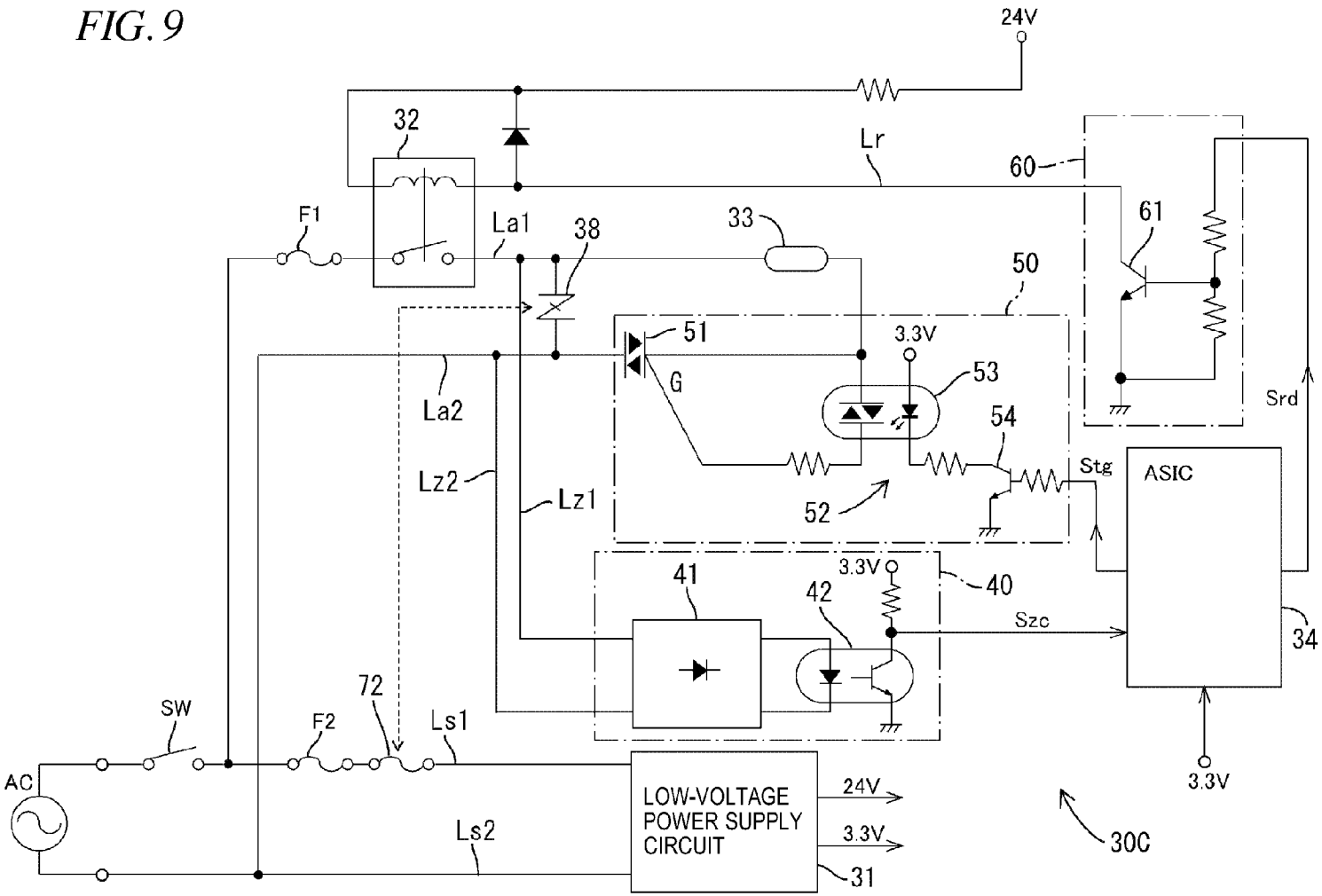
FIG. 9 is a schematic circuit diagram of a heating device according to a fourth exemplary embodiment.

Subsequently, a heating device 30C according to a fourth exemplary embodiment of the invention will be described with reference to FIG. 9. FIG. 9 is a schematic circuit diagram of the heating device 30C according to the fourth exemplary embodiment. The fourth exemplary embodiment is also different from the first exemplary embodiment, as regards the place where the temperature protection device is provided. Hence, the same members as those of the first exemplary embodiment are indicated with the same reference numerals and the descriptions thereof are omitted.

In the fourth exemplary embodiment, the thermal fuse 72 serving as the temperature protection device thermally coupled to the varistor 38 is provided on the power supply line Ls1 connecting the alternating current power supply AC and the low-voltage power supply circuit 31.

(Operations/Effects of Heating Device of Fourth Exemplary Embodiment)

Also in the heating device 30C of the fourth exemplary embodiment, the operations and effects when the fixing relay 32 is off are the same as those of the first exemplary embodiment.

On the other hand, while the fixing relay 32 is on so as to heat the halogen heater 33, when the varistor 38 abnormally generates heat and the thermal fuse 72 is disconnected due to the abnormal heat generation, the AC current Iac is not supplied to the low-voltage power supply circuit 31, so that the operation of the low-voltage power supply circuit 31 stops. Thereby, the DC voltages of 3.3V and 24V for turning on the fixing relay 32 are not generated, so that the fixing relay 32 becomes off and thus the energization to the varistor 38 is stopped. Hence, it is possible to suppress the influence that is caused due to the problem of the varistor 38. That is, the safety of the heating device 30 is improved.

Incidentally, the temperature protection device is not necessarily limited to the thermal fuse 72. For example, the PTC thermistor 71 may be also used. Also in this case, when the temperature of the varistor 38 is increased, the resistance value of the PTC thermistor 71 is increased and the operation of the low-voltage power supply circuit 31 is limited, so that the DC voltages of 3.3V and 24V are not generated. Thereby, it is possible to turn off the fixing relay 32.

Fifth Exemplary Embodiment

Figure 10:
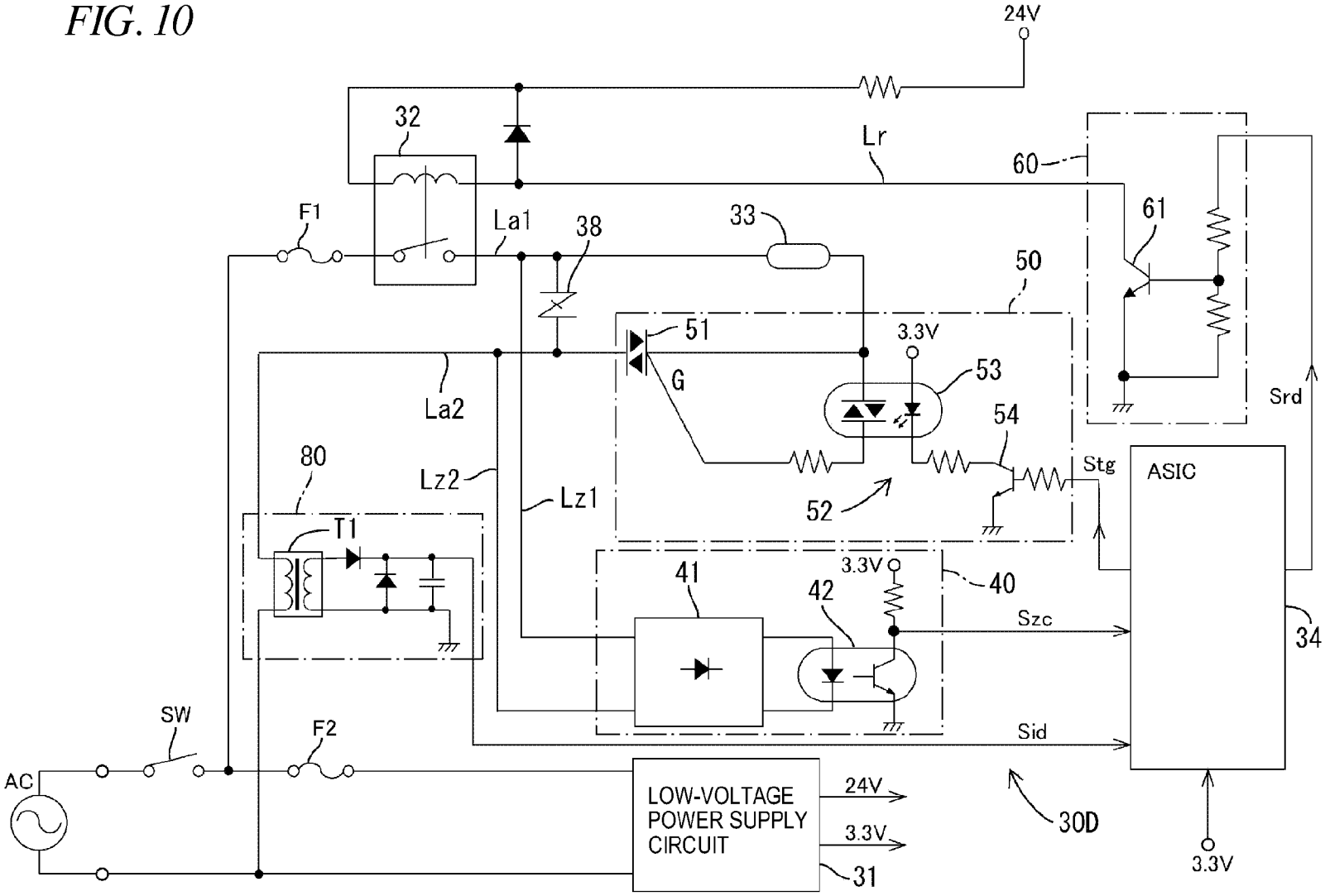
FIG. 10 is a schematic circuit diagram of a heating device according to a fifth exemplary embodiment.

Subsequently, a heating device 30D according to a fifth exemplary embodiment of the invention will be described with reference to FIG. 10. FIG. 10 is a schematic circuit diagram of the heating device 30D according to the fifth exemplary embodiment. The fifth exemplary embodiment is different from the first exemplary embodiment in that an AC current detection circuit 80 is provided instead of the temperature protection device. Hence, the same members as those of the first exemplary embodiment are indicated with the same reference numerals and the descriptions thereof are omitted.

In the fifth exemplary embodiment, as shown in FIG. 10, the AC current detection circuit 80 is provided on the AC power supply line La2 between the alternating current power supply AC and the fixing relay 32. Incidentally, the AC current detection circuit 80 may be provided on the AC power supply line La1. Here, the AC power supply lines La1, La2 between the alternating current power supply AC and the fixing relay 32 correspond to the 'alternating current path that is formed by the alternating current power supply and the high-voltage protection unit.'

The AC current detection circuit 80 includes a current transformer T1, a rectification diode and a capacitor and detects alternating current to thus generate a current detection signal Sid. The current detection signal Sid is supplied to the ASIC 34.

(Operations/Effects of Heating Device of Fifth Exemplary Embodiment)

Also in the heating device 30D of the fourth exemplary embodiment, the operations and effects when the fixing relay 32 is off are the same as those of the first exemplary embodiment.

On the other hand, while the fixing relay 32 is on, when an overvoltage or lightning surge is applied to the varistor 38, so that the resistance of the varistor 38 is decreased and a substantially conductive state is made, an AC current value that is detected by the AC current detection circuit 80 is increased. Therefore, when the AC current is detected by the current detection signal Sid even though the heating control on the halogen heater 33 is not performed, the ASIC 34 can detect the abnormality of the varistor 38, based on the detection.

Other Exemplary Embodiments

The invention is not limited to the above exemplary embodiments. For example, following exemplary embodiments are also included in the technical scope of the invention.

(1) In the above-described exemplary embodiments, the printer 1 may have a using mode, in which the printer 1 is at a using state, and a low-power mode, in which power consumption is lower than in the using mode, and the fixing relay 2 may switch the connection state to the connection in the using mode and switch the connection state to the disconnection in the low-power mode. In this case, when the heating device 30 is used to heat the fixing unit of the printer 1, after the power supply switch of the printer 1 becomes on, the time during which the printer 1 is in the low-power mode is longer than the time during which the printer 1 is in the using mode. Therefore, it is possible to effectively suppress the problem of the varistor 38.

(2) In the above-described exemplary embodiments, the high-voltage protection unit is not limited to the varistor 38. A high-voltage protection unit may be used insomuch as the conducting current is increased and the high-voltage protection unit generates heat when an abnormal high voltage such as overvoltage and lightning surge is applied.

What is claimed is:

1. A heating device comprising:

an alternating current (AC) power supply line configured to supply AC current from an AC power supply, the AC power supply line comprising a first AC power supply line and a second AC power supply line;

a heat generation unit, which is provided on the first AC power supply line, and which is configured to generate heat in accordance with the AC current;

an energization regulation unit, which is provided on the second AC power supply line, and which is configured to regulate energization time of the AC current to the heat generation unit;

a switching unit, which is provided on the first AC power supply line, and which is configured to switch a connection state between the AC power supply and the heat generation unit;

a high-voltage protection unit, which is directly connected between the first AC power supply line and the second AC power supply line, and one terminal of which is connected to the first AC power supply line, and one terminal of which is connected to the second AC power supply line at a rear stage of the switching unit, wherein the high-voltage protection unit is configured to protect the energization regulation unit against an abnormal input high voltage; and a temperature protection device that is thermally coupled to the high-voltage protection unit.

2. The heating device according to claim 1, further comprising:

a regulation driving unit configured to drive the energization regulation unit, wherein the energization regulation unit is a triac, and wherein the temperature protection device is provided between the regulation driving unit and a gate of the triac.

3. The heating device according to claim 2, wherein the temperature protection device is a thermal fuse.

4. The heating device according to claim 2, wherein the temperature protection device is a positive temperature coefficient (PTC) thermistor.

5. The heating device according to claim 1, further comprising:

a regulation driving unit configured to drive the energization regulation unit, wherein the energization regulation unit is a triac, wherein the temperature protection device is a negative temperature coefficient (NTC) thermistor, wherein the regulation driving unit is connected to a gate of the triac, and wherein the NTC thermistor is connected between the gate of the triac and one input/output terminal of the triac.

6. The heating device according to claim 1, further comprising:

a switching driving unit configured to drive the switching unit; and a switching unit driving line that connects the switching unit and the switching driving unit, wherein the temperature protection device is provided on the switching unit driving line.

7. The heating device according to claim 6, wherein the temperature protection device is a thermal fuse.

8. The heating device according to claim 6, wherein the temperature protection device is a PTC thermistor.

9. The heating device according to claim 1, further comprising:

a switching driving unit configured to drive the switching unit;

a low-voltage power supply circuit configured to generate a direct current voltage to be supplied to the switching driving unit; and a power supply line that connects the AC power supply and the low-voltage power supply circuit, wherein the temperature protection device is provided on the power supply line.

10. The heating device according to claim 9, wherein the temperature protection device is a thermal fuse.

11. The heating device according to claim 1, further comprising:

a zero-cross detection unit, which is connected between the first AC power supply line and the second AC power supply line at a rear stage of the switching unit, and which is configured to generate a zero-cross pulse signal for detecting a zero-cross point of the AC current; and a zero-cross line that connects the AC power supply and the zero-cross detection unit, wherein the temperature protection device is provided on the zero-cross line.

12. The heating device according to claim 11, wherein the temperature protection device is an NTC thermistor.

13. The heating device according to claim 11, wherein the temperature protection device is a PTC thermistor.

14. The heating device according to claim 1, further comprising:

an AC current detection unit that is provided on an AC path that is formed by the AC power supply and the high-voltage protection unit.

15. The heating device according to claim 1, wherein the heat generation unit is provided at a rear stage of the high-voltage protection unit.

16. An image forming apparatus comprising:

an image forming unit configured to form a toner image on a recording medium; and a fixing unit, which comprises the heating device according to claim 1, and which is configured to fix the toner image formed by the image forming unit on the recording medium.

17. The image forming apparatus according to claim 16, wherein the image forming apparatus has a using mode, in which the image forming apparatus is at a using state, and a low-power mode, in which power consumption is lower than in the using mode, and wherein the switching unit is configured to switch the connection state to a connection in the using mode, and to switch the connection state to a disconnection in the low-power mode.

* * * * *